US007159657B2

(12) United States Patent
Ratanasirigulchia et al.

(10) Patent No.: US 7,159,657 B2
(45) Date of Patent: Jan. 9, 2007

(54) SHAPED CHARGE LOADING TUBE FOR PERFORATING GUN

(75) Inventors: Wanchai Ratanasirigulchia, Shanghai (CN); Wenbo Yang, Sugar Land, TX (US); Cynthia L. Hickson, Sugar Land, TX (US); Robert A. Parrott, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 183 days.

(21) Appl. No.: 10/708,777

(22) Filed: Mar. 24, 2004

(65) Prior Publication Data

US 2005/0211467 A1 Sep. 29, 2005

(51) Int. Cl.
*E21B 43/116* (2006.01)

(52) U.S. Cl. ..... 166/299; 166/55.2; 166/297; 175/4.6; 102/321.1

(58) Field of Classification Search ..... None
See application file for complete search history.

(56) References Cited

U.S. PATENT DOCUMENTS

| | | | | |
|---|---|---|---|---|
| 2,605,704 | A | | 8/1952 | Dumas |
| 3,237,559 | A | | 3/1966 | Auberlinder |
| 3,528,864 | A | | 9/1970 | Weinland |
| 3,611,932 | A | | 10/1971 | Clator |
| 3,706,280 | A | | 12/1972 | Bobinski et al. |
| 3,855,929 | A | | 12/1974 | Ridgeway |
| 3,971,318 | A | | 7/1976 | Burkle et al. |
| 3,989,792 | A | | 11/1976 | San Miguel |
| 4,011,818 | A | | 3/1977 | Stosz, Jr. et al. |
| 4,050,968 | A | | 9/1977 | Goldhagen et al. |
| 4,088,518 | A | | 5/1978 | Kehren et al. |
| 4,110,136 | A | | 8/1978 | Hershkowitz et al. |
| 4,151,798 | A | | 5/1979 | Ridgeway |
| 4,191,265 | A | * | 3/1980 | Bosse-Platiere ..... 175/4.56 |
| 4,198,739 | A | | 4/1980 | Budinger et al. |
| 4,408,535 | A | | 10/1983 | Alford |
| 4,498,367 | A | | 2/1985 | Skolnick et al. |
| 4,537,255 | A | | 8/1985 | Regalbuto et al. |
| 4,628,819 | A | | 12/1986 | Backofen, Jr. et al. |
| 4,729,318 | A | | 3/1988 | Marsh |
| 4,766,813 | A | | 8/1988 | Winter et al. |
| 4,773,299 | A | * | 9/1988 | Oestreich et al. ..... 89/1.15 |
| 4,829,901 | A | | 5/1989 | Yates, Jr. |
| 4,850,438 | A | | 7/1989 | Regalbuto |
| H866 | H | | 1/1991 | Faccini et al. |
| 5,033,387 | A | | 7/1991 | Lips |
| 5,237,927 | A | | 8/1993 | Gonzalez et al. |
| 5,323,684 | A | | 6/1994 | Umphries |
| 5,333,550 | A | | 8/1994 | Rodney et al. |
| 5,445,078 | A | | 8/1995 | Marion |
| 5,460,095 | A | | 10/1995 | Slagle et al. |
| 5,501,154 | A | | 3/1996 | Rodney et al. |

(Continued)

FOREIGN PATENT DOCUMENTS

| | | |
|---|---|---|
| DE | 3405527 C1 | 2/1984 |

(Continued)

*Primary Examiner*—Zakiya W. Bates
(74) *Attorney, Agent, or Firm*—Clarence E. Eriksen; Bryan P. Galloway; Jaime A. Castano

(57) ABSTRACT

The loading tube comprises cups forming cup cavities for enclosing an explosive charge within each of the cups. The loading tube has ridges and valleys providing longitudinal and lateral strength to the loading tube. The loading tube is constructed of a formed material such as paper pulp, high-density polystyrene, plastic or sheet metal.

23 Claims, 5 Drawing Sheets

U.S. PATENT DOCUMENTS

| | | | |
|---|---|---|---|
| 5,509,356 | A | 4/1996 | Renfro |
| 5,656,791 | A | 8/1997 | Reese et al. |
| 5,785,130 | A | 7/1998 | Wesson et al. |
| 5,827,995 | A | 10/1998 | Graham |
| 5,829,538 | A | 11/1998 | Wesson et al. |
| 5,837,925 | A | 11/1998 | Nice |
| 5,859,383 | A | 1/1999 | Davison et al. |
| 5,910,638 | A | 6/1999 | Spencer et al. |
| 5,939,664 | A | 8/1999 | Ridgeway |
| 5,960,894 | A | 10/1999 | Lilly et al. |
| 6,021,714 | A | 2/2000 | Grove et al. |
| 6,035,785 | A | 3/2000 | Sabathier et al. |
| 6,062,310 | A | 5/2000 | Wesson et al. |
| 6,209,457 | B1 | 4/2001 | Kenworthy et al. |
| 6,378,438 | B1 | 4/2002 | Lussier et al. |
| 6,422,148 | B1 | 7/2002 | Xu et al. |
| 6,453,817 | B1 | 9/2002 | Markel et al. |
| 6,499,406 | B1 | 12/2002 | Shim |
| 6,520,258 | B1 | 2/2003 | Yang et al. |
| 2002/0189482 | A1 | 12/2002 | Kneisl et al. |

FOREIGN PATENT DOCUMENTS

| | | | |
|---|---|---|---|
| DE | 3739667 | A1 | 11/1987 |

* cited by examiner

SHAPED CHARGE LOADING TUBE FOR PERFORATING GUN

BACKGROUND OF INVENTION

The present invention relates in general to downhole perforating gun assemblies. More particularly the present invention relates to a loading tube for holding charges for insertion into a perforating gun carrier.

A perforating gun is commonly used to form perforations in a wellbore to increase the production between the wellbore and the producing formation adjacent to the wellbore. The perforating gun may be part of a perforating gun assembly, an assembly that may include several perforating guns and other components. The perforating gun and associated assembly are selected based on wellbore and producing formation characteristics. Some of the criteria for a particular perforating gun will be the shot spacing, shot phasing and the perforating length for the perforation gun.

The perforating gun assembly is typically positioned downhole to the desired perforating depth via a wireline or tubing, as examples. The firing of the perforating gun normally involves detonating its shaped charges that create radial perforation jets when detonated to form perforation tunnels from the wellbore into the producing formation.

Each perforating gun may consist of an outer cylindrical tube, often referred to as a carrier, and a loading tube located inside of the carrier. The carrier acts like a pressure vessel for the perforating gun and the shaped charges.

One of the main functions of the loading tube is to mechanically hold the shaped charges within the carrier at a certain phasing and spacing.

In the past, the loading tube has primarily been constructed of metallic materials. In particular, the loading tubes are commonly constructed of cut round steel tubes to achieve the desired shot phasing and density. The loading tubes have commonly included either a plastic jacket to mount and hold the shaped charges to the cut metal loading tube, or have metal fingers formed by the metal loading tube to mount and hold the shaped charges.

These prior art cut metal loading tubes have several disadvantages. First, when the shaped charges are detonated, the metal loading tube expands due to the case impact and explosive gaseous expansion. As soon as the loading tube collides with the inner diameter of the carrier, the energy from the loading tube is transmitted to the carrier. The metal carrier then swells outwardly under the impact of the loading tube and may fragment into pieces. This process and interaction is disadvantageous for numerous reasons, including swelling and or deformation of the carrier resulting in sticking in the wellbore when attempting to remove the perforating gun from the wellbore, fragmentation of the carrier and/or the loading tube that may leave excessive debris that may reduce production from the well and/or cause sticking of the perforating gun in the wellbore.

Additionally, the cut metal loading tube is relatively expensive and the metallic fingers increases the cost of production. The metallic fingers further provide little shock protection for the charges during transportation or conveyance of the gun. Due to the tendency of the fingers to fail the incidence of misruns of the perforating gun are increased.

The utilization of plastic jackets for the charges provides relatively good shock protection for the charges relative to the use of "metal fingers" formed by the metallic loading tube. However, these plastic jackets add expense to the perforating gun and often leave excessive debris in the wellbore.

There have been attempts to utilize low density polystyrene as a loading tube to reduce the cost relative to cut metallic loading tubes. However, failures commonly occur due to lack of strength of the loading tube especially at temperatures above approximately 210 degrees Fahrenheit.

Therefore, it is a desire to provide a loading tube for a perforating gun that addresses disadvantages of prior perforating guns and loading tubes. It is a still further desire to provide a loading tube for a perforating gun that provides shock protection for the carried charges during transportation and conveyance. It is a still further desire to provide a loading tube for a perforating gun that minimizes the debris left in the wellbore after detonation of the carried charges. It is a still further desire to provide a loading tube for a perforating gun that facilitates ease and accuracy in mounting charges in a loading tube.

SUMMARY OF INVENTION

In view of the foregoing and other considerations, the present invention relates to perforating guns and more particularly to loading tubes for perforating guns.

Accordingly, a loading tube for a perforating gun is provided. The loading tube comprises cups forming cup cavities for enclosing an explosive charge within each of the cups, and ridges forming valleys therebetween.

The loading tube is created from a formed material. The loading tube may be formed by stamping or molding a material such as paper pulp, plastic, high-density polystyrene, sheet metal or other equivalent material. Portions of the loading tube may be cut, for example, to facilitate operational contact of the detonation cord with the explosive charges.

The loading tube is divided into at least two longitudinal sections. Various numbers of longitudinal sections may exist depending on the shot spacing and phasing of the loading tube. Each of the longitudinal sections is connected along at least one longitudinal edge, or fold seam, to another longitudinal section. The longitudinal sections can be folded to the closed position to form a cylinder.

Each of the longitudinal sections forms cup sections each having an associated cup cavity section, the cup sections and cup cavity sections form part of a cup and cup cavity for holding an explosive charge when the loading tube is in the folded or closed position. Each cup and corresponding cup cavity may be shaped to match the profile of an explosive charge. In this manner each explosive charge along the loading charge is spaced and oriented to achieve the desired shot spacing and phasing.

The cups and cup cavities are formed by cup sections and cup cavity sections formed laterally along each of the longitudinal sections of the loading tube when the loading tube is folded into the closed position. Each of the cup cavities is shaped to match a portion of the profile of an explosive charge. When viewing the loading tube in the open position the various cup sections are shown formed along each longitudinal section as a row and laterally across the longitudinal sections in a column. When the loading tube is formed into a cylindrical shape the cup sections aligned laterally, or in the column, mesh to form the cups and the cup cavities.

The formed loading tube of the present invention creates a loading tube having ridges and valleys. The valleys are formed between the cup ridges. The ridges and valleys provide lateral and longitudinal strength to the loading tube.

The lateral and longitudinal strength of the loading tube maintains the charges in a set position during transport and conveyance into the wellbore, thus reducing misruns of the perforating gun due to the shifting of the charges. The longitudinal edges of the sections, or fold seams, may also form section ridges that provide strength to the loading tube. The section ridges will form valleys between the section ridges and the cup ridges.

In use of the invention explosive charges, commonly shaped charges, are placed in each of the cup cavity sections along one of the longitudinal sections. The profile of the cup cavity and the explosive charge facilitates quick and easy placement of the explosive charges in the loading tube to match the shot spacing and phasing desired. The loading tube is then folded about the longitudinal section holding the explosive charges. Each of the charges is now substantially held internally within a cup cavity by the various cup sections aligned laterally across the longitudinal sections.

The loading tube may then be secured in the closed position in numerous ways before or after connecting the detonation means with the explosive charges. For example purposes, the detonation cord is wrapped around the closed loading tube with the detonation cord in operational contact with each of the explosive charges. If desired additional mechanisms may be utilized to secure the loading tube. If necessary, multiple loading tubes may be connected end to end to for the perforating length desired.

The loading tube, including the explosive charges and detonation mechanism, is inserted into a carrier to form a perforating gun. The perforating gun assembly is completed and run into the wellbore to the desired depth. The perforating gun is then activated detonating the charges in the desired shot spacing and phasing.

The foregoing has outlined the features and technical advantages of the present invention in order that the detailed description of the invention that follows may be better understood. Additional features and advantages of the invention will be described hereinafter which form the subject of the claims of the invention.

BRIEF DESCRIPTION OF DRAWINGS

The foregoing and other features and aspects of the present invention will be best understood with reference to the following detailed description of a specific embodiment of the invention, when read in conjunction with the accompanying drawings, wherein.

DETAILED DESCRIPTION

Figure 1:
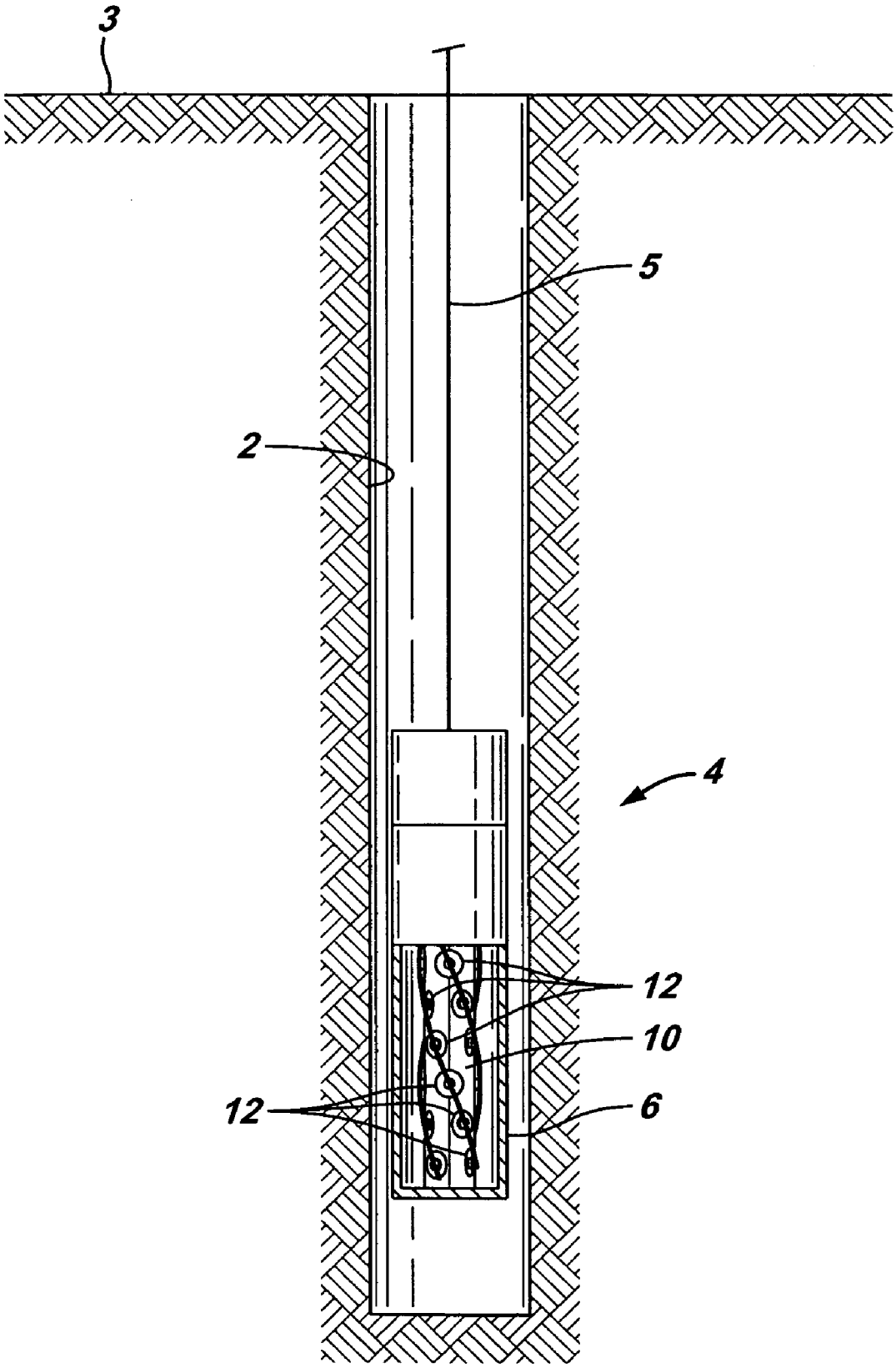
FIG. 1 is an illustrative view of a wellbore and a perforating gun.

Refer now to the drawings wherein depicted elements are not necessarily shown to scale and wherein like or similar elements are designated by the same reference numeral through the several views.

FIG. 1 illustrates a wellbore 2 extending into the ground from the surface 3. A perforating gun assembly 4 is disposed within wellbore 2 to perforate wellbore 2. Perforating gun 4 is positioned within wellbore 2 by a conveyance mechanism 5, such as a wireline, coiled tubing or other conveyance mechanism well known in the art. Perforating gun 4 includes a carrier 6 and a loading tube 10.

Figure 2:
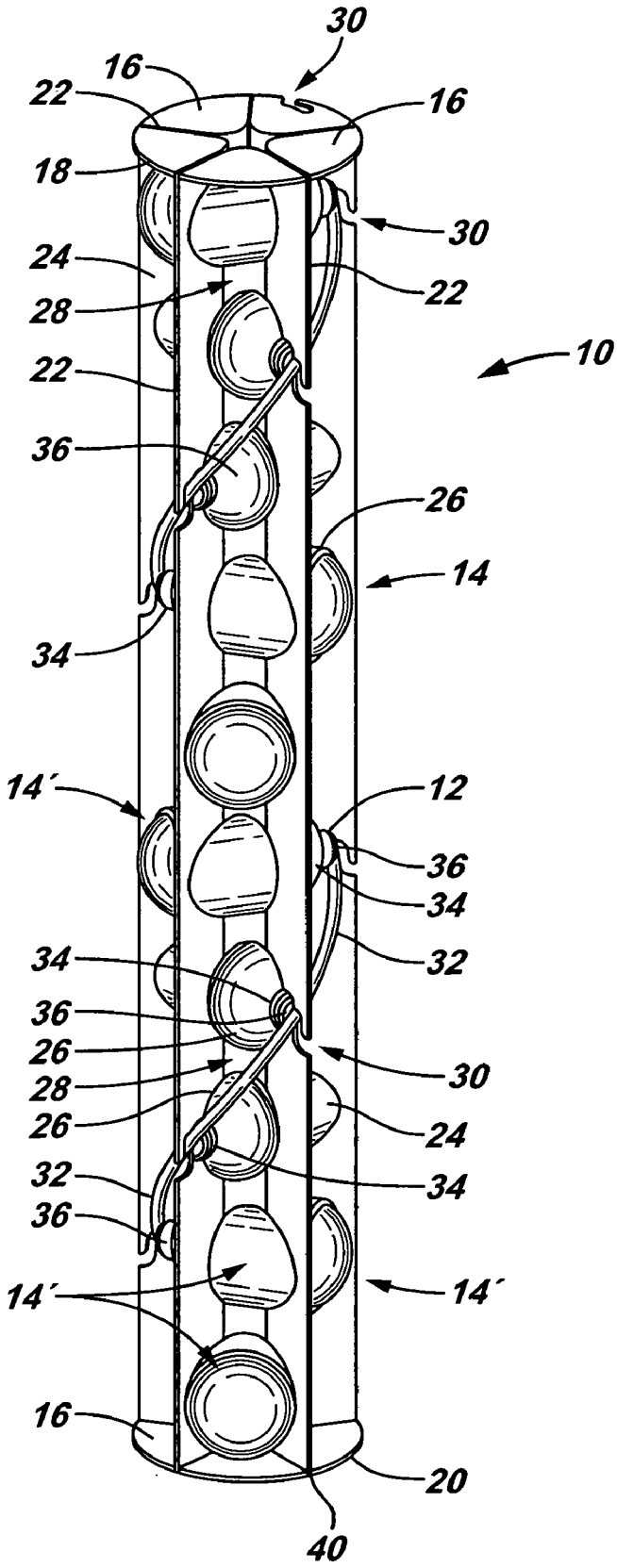
FIG. 2 is perspective view of a shaped charge loading tube of the present invention.

FIG. 2 is a perspective view of a shaped charge loading tube for a perforation gun of the present invention, generally designated by the numeral 10. Loading tube 10 is adapted for internally holding and carrying shaped explosive charges 12 for placement in carrier 6 to form perforating gun 4 (FIG. 1). Loading tube 10 forms cups 14 for holding shaped charges 12 therein.

For illustration purposes, loading tube 10 of FIGS. 2 through 7 is a two foot length, five shots per foot, seventy-two degree shot phasing loading tube. Loading tube 10 may be formed for other shot densities, shot phasing and loading tube lengths as desired pursuant to the invention.

Loading tube 10 is constructed of a substantially single piece of material that may include several elements. Loading tube 10 may be constructed of a material such as, but not limited to, paper pulp, plastic, high density polystyrene, sheet metal and card board. Additives such as, but not limited to, metal, glass, plastic, carbon, natural or synthetic fibers, and chemicals including oxidizers, propellants, and explosives, may be incorporated into the material to achieve desired loading tube 10 properties such as strength, flexibility, disintegration or other desired loading tube 10 properties. For purposes of example loading 10 is described as constructed of paper pulp. Loading tube 10 is formed substantially by stamping or molding the material.

Loading tube 10 may be formed in varying length sections or it may be desired to form loading tube 10 in a set length section, such as two feet. Multiple loading tubes 10 may be connected end to end in order to obtain the desired perforation length desired. Separate loading tubes 10 may be interconnected by various mechanisms to create a desired loading tube 10 for the perforating length desired. Loading tubes 10 of the present invention facilitate ease and time efficient mechanisms for connecting multiple loading tubes to obtain the desired perforating length.

Loading tubes 10 may be interconnected end to end by connecting mechanisms well known in the art including, but not limited to, wrapping detonation cord 32 around loading tubes 10, connecting the ends of adjacent loading tubes 10 with an adhesive such as tape and/or stapling or tacking the ends of the loading tubes 10 together. Additionally, loading tube 10 of the present invention permits ease of alteration of a loading tube 10 by cutting a loading tube to achieve the desired perforation length desired.

Loading tube 10 is formed to have longitudinal sections 16. Each section 16 having a first end 18 and a second end 20. The number of sections 16 is determined by the shot density and shot phasing of loading tube 10. Each section forms a section ridge 22 that provides strength to loading tube 10.

Each section 16 forms a portion 14' of each individual cup 14. The external surface 24 of cup portions 14' extend outwardly forming cup ridges 26. Valleys 28 are formed between the section ridges 22 and adjacent cup ridges 26.

The combination of section ridges 22, cup ridges 26 and valleys 28 enhance the longitudinal and lateral strength of load tube 10.

Cups 14 have cup backs 34 formed to dispose the charge back 36 of shaped charge 12 therein. A slot 30 is cut at the cup back 34 of each cup 14 to substantially expose the charge back 36 contained in the cup 14. A detonation cord 32 is disposed within slots 30 to contact the charge back 36 of each shaped charge 12. It may be desired for slots 30 to have a non-linear path to secure detonation cord 32 within slots 30. Further, by wrapping detonation cord 32 about the exterior 24 of loading tube 10, loading tube 10 is secured in its folded or closed and completed form as shown in FIG. 2.

Figure 3:
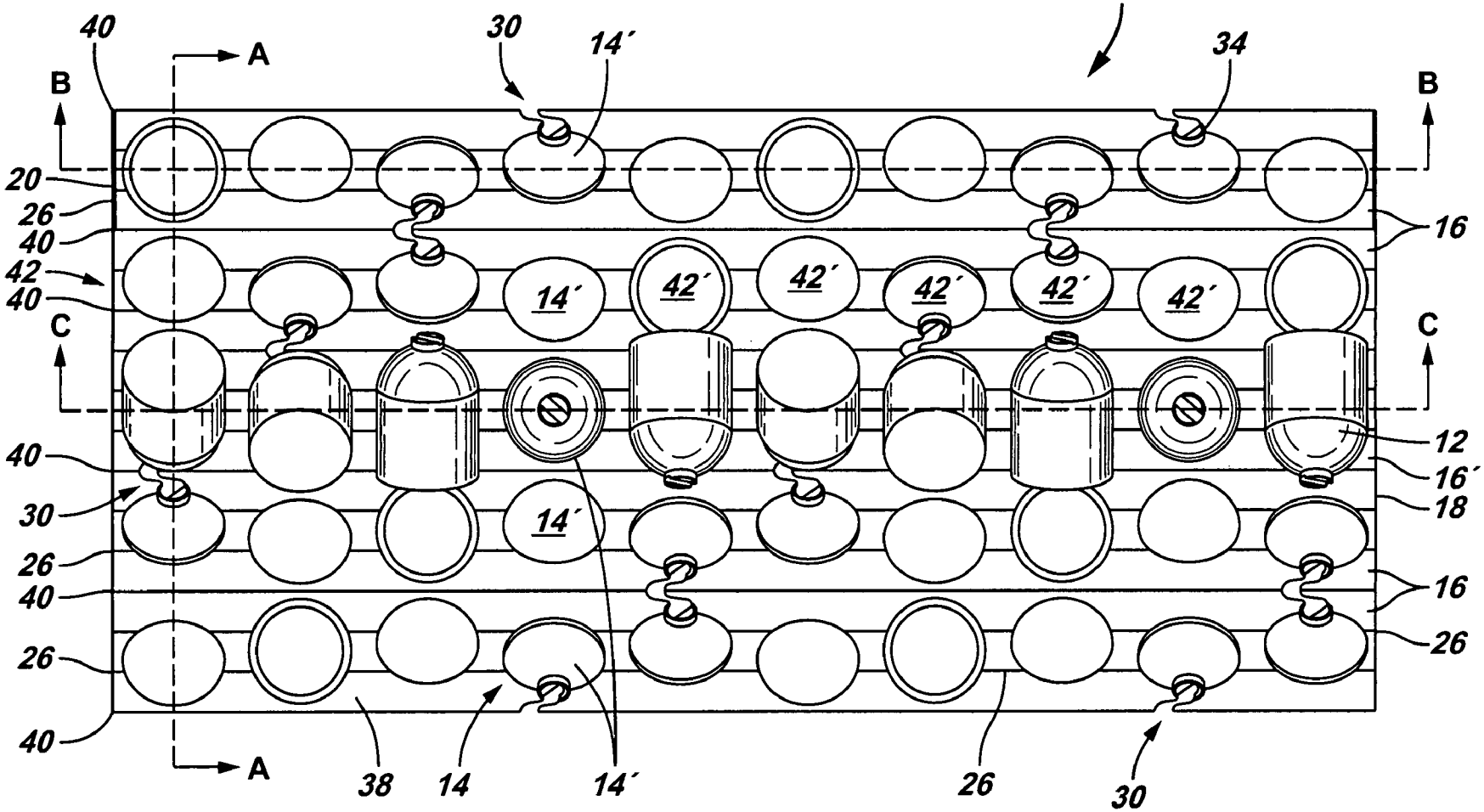
FIG. 3 is a top view of a loading tube of the present invention in the unfolded or open position exposing the interior surface of the loading tube.

FIG. 3 is a top view of loading tube 10 in the unfolded position exposing the interior surface 38 of loading tube 10. Loading tube 10 is formed by stamping or molding and may include cutting sections of loading tube 20. Each section 16 is divided from the adjacent section 16, along at least one longitudinal side, denoted as a fold seam 40, extending along the longitudinal axis of loading tube 10.

As has been described, each individual cup 14 is formed by cup sections 14' of each section 16. Each individual cup 14 forms a cup cavity 42 for fittedly disposing a shaped charge 12 therein. As shown in FIG. 3, each individual cup cavity 42 is formed by cup cavity sections 42' defined by each cup section 14'. Each cup cavity 42 is defined when loading tube 10 is in the folded or closed position as shown in FIG. 2.

Cup cavities 42 are formed in the interior of loading tube 10. Each individual cup cavity 42 is formed to fit the profile of a shaped charge 12 in a set orientation. The sequence of cups 14 along the length of loading tube 10 are oriented so that each cup 14 is directed in the desired direction to achieve the phasing desired. Ten shaped charges 12 are shown positioned along the middle longitudinal section 16 (identified as 16N) to form a two foot long loading tube 10. Each shaped charge 12 is fitted into a cup cavity section 42' defined by section 16N. It should be noted that 16N may be any of the sections, but is illustrated as the middle section 16. Each cup 14N and corresponding cup cavity section 42N is shaped to fit the profile of a portion of a charge 12, thus orienting shaped charges 12 in the proper alignment to achieve the desired shot phasing. As shown in FIG. 3 loading tube 10 is prepared for folding to the closed position for completion.

Figure 4:
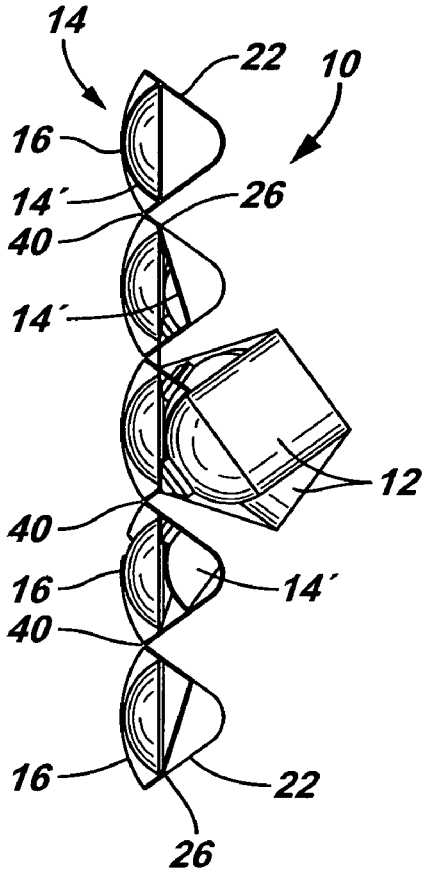
FIG. 4 is a plan view of a loading tube of the present invention along the line A—A of FIG. 3.

FIG. 4 is a plan view of loading tube 10 shown along the line A—A of FIG. 3. As shown along the middle section 16 (identified as 16N) of loading tube 10, each shaped charge 12 is positioned within a cup portion 14N formed by section 16N of loading tube 12, thereby positioning each shaped charge 12 in an orientation to achieve the shot phasing desired. FIG. 4 also indicates how individual cup sections 14N formed by each longitudinal sections 16 laterally across loading tube 10 (illustrated along lateral line A—A of FIG. 3) form an individual cup 14.

Figure 5:
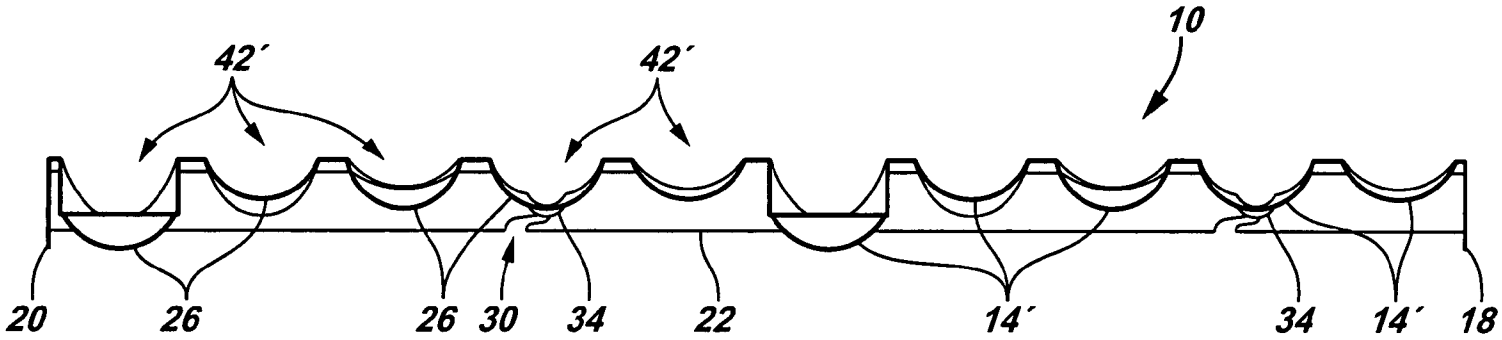
FIG. 5 is a plan view of a loading tube of the present invention shown along the line B—B of FIG. 3.

FIG. 5 is a plan view of loading tube 10 shown along the the various cup sections 14N and cup cavity sections 42N formed along a longitudinal section 16.

Figure 6:
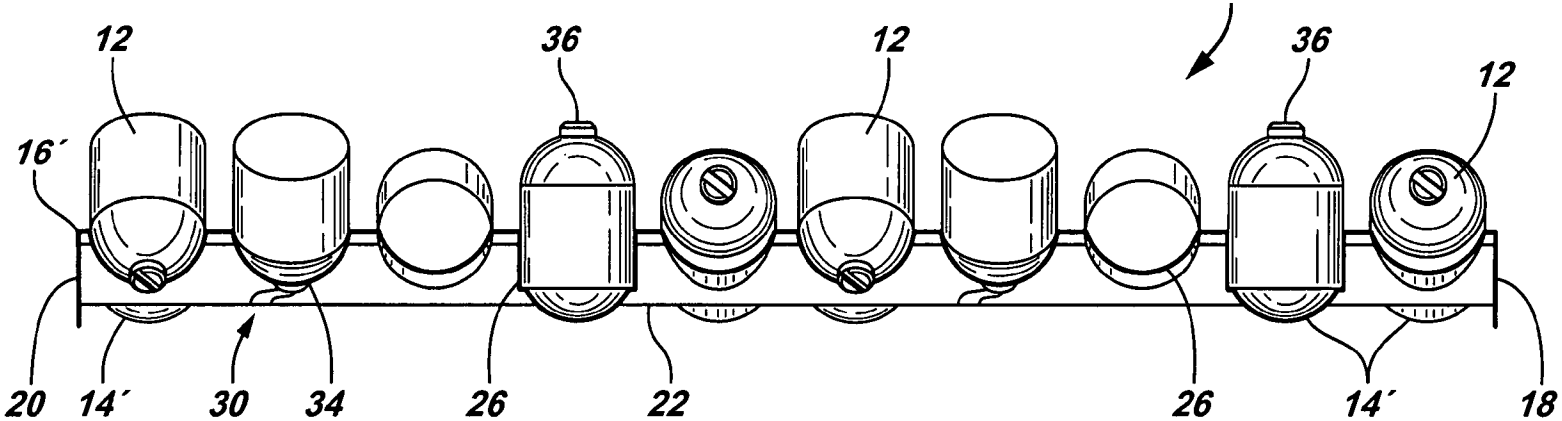
FIG. 6 is a plan view of a loading tube of the present invention shown along the line C—C of FIG. 3.

FIG. 6 is a plan view of loading tube 10 shown along the line C—C of FIG. 3. This Figure discloses shaped charges 12 being placed in each cup cavity section 42N (FIG. 5) of longitudinal section 16N. Each shaped charge 12 is fitted into the shaped cup section 14N orienting shaped charges 12 into the desired shot pattern and the desired number of shots per foot.

Figure 7:
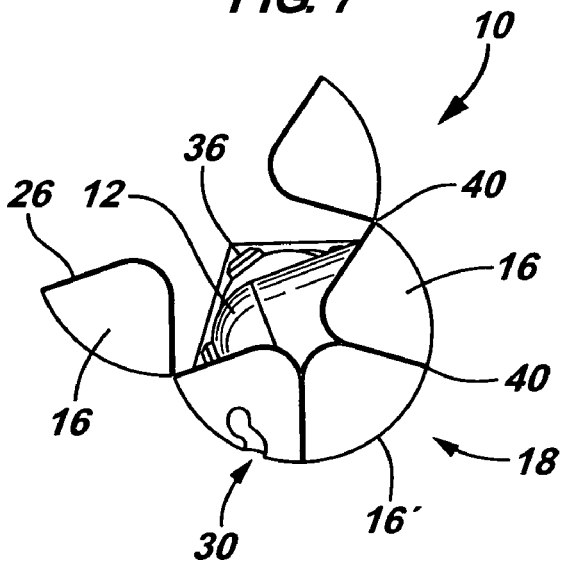
FIG. 7 is an end view of a loading tube of the present invention folded between the open position of FIG. 3 and the closed position of FIG. 2.

FIG. 7 is an end view of a loading tube 10 of the present invention folded between the open position of FIG. 3 and the closed position of FIG. 2. In this view shaped charges 12 have been placed in the cup cavities sections 42N of section 16N. The remaining sections 16 are then folded around shaped charges 12 placed in section 16N resulting in the closed version of loading tube 10 shown in FIG. 2.

With reference to FIGS. 2 through 7, it should be recognized that loading tube 10 may include varying numbers of sections 16. FIGS. 2 through 7 show a five shot per foot loading tube 10 having a shot phasing of seventy-two degrees and having six longitudinal sections 16. For example, a six shot per foot loading tube 10 having a shot phasing of sixty degrees may include only three longitudinal sections 16. Another example is a four shot per foot loading tube 10 having a shot phasing of forty-five degrees may have four longitudinal sections 16.

Preparation and use of loading tube 10 of the present invention is now described with reference to FIGS. 1 through 7. A shot pattern and shot phasing is chosen for a perforating job to be performed, such as a five foot shot per foot pattern with a shot phasing of seventy-two degrees. A loading tube 10 length, such as two feet is selected. A material of construction is chosen, such as but not limited to paper pulp, plastic, high density polystyrene, sheet metal and card board. Desirably the material of construction is chosen as to be readily available, inexpensive, lightweight, limiting interference with the perforation process and providing the physical properties suited for support of charges 12 pursuant to the wellbore 2 conditions, such as temperature and the wellbore fluid, that are to be encountered.

For purposes of example the material of construction of loading tube 10 is a paper pulp. Paper pulp is stamped or molded to create longitudinal sections 16 wherein each section 16 forms cup sections 14N indicated along the line B—B of FIG. 3. The paper pulp may include additives to provide additional strength or other characteristics desired for the wellbore conditions. This process and design forms ridges 22, 26 and valleys 28 that provide both lateral and longitudinal support for loading tube 10 when it carries shaped charges 12. The present invention provides that loading tube 10, no matter the material of construction, is substantially formed by molding or stamping in a flat configuration that may then be folded, or rolled, into a substantially cylindrical, closed loading tube 10. This process of forming loading tube 10 reduces the costs of producing loading tube 10 and facilitates the creation of ridges and valleys for strength. Although it should be realized that portions of loading tube 10 may be cut.

The adjacent cup sections 14N of each section 16 are spaced to achieve the desired shot spacing, such as five shots per foot. Additionally, cup sections 14N are laterally aligned between the sections 16 (shown along the line A—A of FIG. 3) to form individual cups 14. Each cup section 14N defines a cup cavity 42N that is configured to match the profile of a portion of a shaped charge 12 so that when loading tube 12 is folded about shaped charge 12, shaped charge 12 is contained within cup cavity 42 formed by cup 14.

In preparation for performing a perforation operation an operator places a charge in cup cavities 42N formed by the cup sections 14N along a longitudinal section 16N. Each of the shaped charges 12 is fitted into the cup section 14N pursuant to the profile of shaped charge 12 and the cup section 14N profile, thereby orienting shaped charges 12 in the desired shot phasing.

Loading tube 10 is then folded so as to substantially form a cylinder, having ridges and valleys, wherein each of the shaped charges 12 are substantially encapsulated within cups 14, formed by cup sections 14N laterally aligned across loading tube 10. Loading tube 10 may then be secured in the closed position for transport or be assembled for detonation. Mechanisms for securing loading tube 10 in the closed position are numerous including utilizing an adhesive such as tape or other known adhesive, mechanical attachment mechanisms and/or wrapping of the detonation cord about the closed loading tube 10.

Detonation cord 32 is placed into and secured within slots 32 so as to be in contact with shaped charge back 36. It may be desired for slots 32 to be linearly offset and/or sized to securely hold detonation cord 32 in a set position. It may further be desired to wrap detonation cord 32 about the circumference of the closed loading tube 10 to secure loading tube 10 in the closed position. In order to achieve the desired perforation length multiple loading tubes 10 may be interconnected. For example, ten two-foot length loading tubes may be secured end to end (preferably end 18 to end 20) to create a twenty foot perforating section having a set shot per foot and shot phasing. The present invention also provides ease in cutting a loading tube 10 length to adjust the overall length of the perforating gun length.

Upon closing, loading tube 10 may be secured and inserted into carrier 6 to form perforating gun 4. Operation of perforating gun 4 utilizing loading tube 10 of the present invention may then be performed as is well known in the art.

From the foregoing detailed description of specific embodiments of the invention, it should be apparent that a shaped charge loading tube system for perforating guns that is novel has been disclosed. Although specific embodiments of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed embodiments without departing from the spirit and scope of the invention as defined by the appended claims which follow.

The invention claimed is:

1. A loading tube for a perforating gun comprising cups forming cup cavities for enclosing an explosive charge within each of the cups, and ridges forming valleys therebetween wherein the loading tube includes at least two longitudinal sections, each section forming more than one cup section and associated cup cavity section, each cup section and associated cup cavity section being laterally aligned with the cup sections and associated cup cavity sections of the other longitudinal sections to form the cups and the cup cavities.

2. The loading tube of claim 1 wherein each of the longitudinal sections is connected to the adjacent longitudinal section along a longitudinal fold seam in a manner such that the adjacent longitudinal sections can be folded together.

3. The loading tube of claim 1 wherein the loading tube is constructed of formed paper pulp.

4. The loading tube of claim 1 wherein the loading tube is constructed of formed sheet metal.

5. The loading tube of claim 1 wherein the loading tube is constructed of formed plastic.

6. The loading tube of claim 1 wherein the loading tube is constructed of formed high-density polystyrene.

7. The loading tube of claim 1, wherein each cup cavity is formed to match the profile of one of the explosive charges.

8. The loading tube of claim 7 wherein the loading tube is constructed of formed paper pulp.

9. The loading tube of claim 7 wherein the loading tube is constructed of formed sheet metal.

10. The loading tube of claim 7 wherein the loading tube is constructed of formed plastic.

11. The loading tube of claim 7 wherein the loading tube is constructed of formed high-density polystyrene.

12. A loading tube for a perforating gun comprising:

cups forming cup cavities for enclosing an explosive charge within each of the cups, each cup shaped to match the profile of one of the explosive charges;

at least two longitudinal sections, each longitudinal section forming more than one cup section and associated cup cavity section, each cup section and associated cup cavity section being laterally aligned with cup sections and associated cup cavity sections of the other longitudinal sections to form the cups and the cup cavities when the longitudinal sections are folded into a closed position, wherein each of the longitudinal sections is connected to another of the longitudinal section along at least one longitudinal fold seam in a manner such that the adjacent longitudinal sections can be folded together into the closed position; and ridges forming valleys therebetween.

13. The loading tube of claim 12 wherein the loading tube is constructed of formed paper pulp.

14. The loading tube of claim 12 wherein the loading tube is constructed of formed sheet metal.

15. The loading tube of claim 12 wherein the loading tube is constructed of formed plastic.

16. The loading tube of claim 12 wherein the loading tube is constructed of formed high-density polystyrene.

17. A method of operating a perforating gun comprising the steps of:

providing a loading tube comprising at least two longitudinal sections, each of the longitudinal sections connected to another of the longitudinal sections along at least one longitudinal fold seam, each longitudinal section having cup sections each defining an associated cup cavity section formed along the longitudinal length thereof, each of the cup sections and the associated cup cavity sections corresponding laterally aligned cup sections and the associated cup cavity sections formed by the other longitudinal sections to form a cup and a cup cavity shaped to match a profile of an explosive charge and retain the explosive charge within the cup of a closed loading tube, and the loading tube forming ridges and valleys;

placing explosive charges within the cup cavities formed by one of the longitudinal sections;

folding the other longitudinal sections about the explosive charges to form a substantially cylindrical loading tube containing oriented explosive charges therein;

connecting a detonation means in operational contact with each of the explosive charges;

placing the loading tube in a carrier to form a perforating gun;

running the perforating gun in a wellbore; and detonating the explosive charges.

18. The method of claim 17 wherein the loading tube is constructed of formed paper pulp.

19. The method of claim 17 wherein the loading tube is constructed of formed sheet metal.

20. The method of claim 17 wherein the loading tube is constructed of formed plastic.

21. The method of claim 17 wherein the loading tube is constructed of formed high-density polystyrene.

22. A method of constructing a loading tube for a perforating gun comprising the steps of:

forming a material to have a pattern of explosive charge cups formed along longitudinal sections of the material;

placing explosive charges within the explosive charge cups along one of the longitudinal sections; and folding the longitudinal sections together to substantially enclose the explosive charges within a substantially cylindrical tube.

23. The method of claim 22 further including providing slots in the explosive charge cups for placement of a detonation cord in operational connection with the contained explosive charge.

* * * * *